US005829372A

United States Patent [19]

Aubourg et al.

[11] Patent Number: 5,829,372

[45] Date of Patent: Nov. 3, 1998

[54] MECHANICAL TUFTING HEAD

[75] Inventors: Peter Leonard Aubourg, Otford; Robert Gabor Pongrass, Woollahra; William Brian Wilson, Davidson, all of Australia

[73] Assignee: Wilcom Tufting Pty Ltd., New South Wales, Australia

[21] Appl. No.: 648,125

[22] PCT Filed: Nov. 23, 1994

[86] PCT No.: PCT/AU94/00718

§ 371 Date: Aug. 13, 1996

§ 102(e) Date: Aug. 13, 1996

[87] PCT Pub. No.: WO95/14804

PCT Pub. Date: Jun. 1, 1995

[30] Foreign Application Priority Data

Nov. 23, 1993 [AT] Austria ..... PM2583

[51] Int. Cl.[6] ..... D05C 15/20

[52] U.S. Cl. ..... 112/80.16; 112/80.45

[58] Field of Search ..... 112/80.01, 80.05, 112/80.08, 80.16, 80.4, 80.45

[56] References Cited

U.S. PATENT DOCUMENTS

| | | | |
|---|---|---|---|
| 1,487,318 | 3/1924 | De Forest | 112/80.05 X |
| 1,557,970 | 10/1925 | Borrows et al. . | |
| 1,862,768 | 6/1932 | Rice . | |
| 2,528,392 | 10/1950 | Self | 112/80.16 |
| 2,954,749 | 10/1960 | Koppelman . | |
| 3,142,276 | 7/1964 | Schauer | 112/80.05 X |
| 4,669,406 | 6/1987 | Muroya . | |
| 4,860,674 | 8/1989 | Slattery . | |
| 5,503,092 | 4/1996 | Aubourg et al. | 112/80.23 |

FOREIGN PATENT DOCUMENTS

| | | |
|---|---|---|
| 22774/77 | 9/1978 | Australia . |
| 1-014338 | 1/1987 | Japan . |
| 63-264961 | 11/1988 | Japan . |
| 1-033585 | 7/1989 | Japan . |
| 2-118155 | 5/1990 | Japan . |
| 2-027468 | 6/1990 | Japan . |
| 2-234969 | 9/1990 | Japan . |
| 3-199459 | 8/1991 | Japan . |
| 3-060946 | 9/1991 | Japan . |
| 4-057956 | 2/1992 | Japan . |
| 4-028822 | 5/1992 | Japan . |
| 2033438 | 5/1980 | United Kingdom . |

*Primary Examiner*—Peter Nerbun
*Attorney, Agent, or Firm*—Townsend and Townsend and Crew LLP

[57] ABSTRACT

This invention concerns a mechanical tufting head. In particular it concerns a tufting head suitable for use in a hand-held tufting gun, or for automated use in the production of individualized rugs or carpets.

13 Claims, 9 Drawing Sheets

MECHANICAL TUFTING HEAD

BACKGROUND ART

Co-pending International Application No. PCT/AU92/00401 (WO 93/03215) describes a method and system of tufting. It also describes a mechanical tufting head with reference to FIGS. 17 and 18.

In that mechanical tufting head, yarn is fed down a yarn tube to a reciprocating needle. A reciprocating forked rod, or blade, drives tufts of wool down through the hollow needle. The blade is mounted on a carriage which reciprocates up and down along a first rail in a rotatable part of the head. A hollow tube extends upward from the carriage, concentric with the axis of the yarn tube, and outside it. At its upper end the tube is connected to a slide which is driven up and down along a second rail in a non-rotatable part of the head. The upper end of the tube is rotatably mounted in the slide to permit rotation of the rotatable parts.

The needle is also attached to a carriage which is slidable along the first rail in the rotatable part of the housing. The needle carriage also has a (second) hollow tube extending upwardly from it, again concentric with the yarn tube, and outside both the tube associated with the blade carriage and the yarn tube. The upper end of the second hollow tube is also rotatably connected to a further slide which is driven up and down and guided in its reciprocating motion by the second rail.

The advantage of this arrangement is that a motor supplying the reciprocating motion can be connected directly to the non-rotatable parts of the tufting head, which avoids any possibility of the electrical connections to the motor being tangled by rotation of the head.

However, in practice this mechanical tufting head has been found to be difficult to balance due to the complexity of its mechanism. A result is that the head vibrates increasingly as the speed of operation is increased, and this limits the maximum speed of operation. The mechanism is also massive, which in turn requires heavyweight mounting apparatus for both the head and the backing which is to be tufted. An additional problem caused by the massiveness is the size of the motor required to move the head. Further the massive head is slow to rotate, and typically 30% to 40% of the operational time will be spent turning the head rather than tufting.

SUMMARY OF THE INVENTION

The present invention provides a mechanical tufting head, comprising:

- a tufting needle mount connected to the lower end of a hollow shaft, the hollow shaft being mounted for rotation about the axis of the yarn path and able to reciprocate along it; and
- a blade carriage mounted about the hollow shaft, such that the blade carriage is able to rotate with respect to the axis of the yarn path and reciprocate along the hollow shaft.

This configuration uses the hollow needle shaft to support the blade carriage and, as a result allows a more compact tufting head to be made in comparison with the earlier known mechanism. The head need be only half the length of the earlier head and may be much less massive, which allows faster operation and causes less vibration.

A further benefit of the arrangement is that it permits continuous rotation of the needle and blade while the driving motors and linkage mechanisms may be held stationary. As a result the needle may always be rotated between two directions along the shortest path.

The rotatable parts of the head can be turned by the use of gear means, such as a toothed pulley, situated in the lower part of the head adjacent the needle. The pulley may be keyed to the needle mount in order to allow for very fast rotation. The pulley may also be keyed to the blade carriage.

In one embodiment a needle drive collar is rotatably connected to the upper end of the hollow shaft. Also, the blade carriage is rotatably connected to a blade slide which is able to translate up and down along the hollow shaft. The blade slide and the needle drive collar are both keyed into a track which allows them to reciprocate but prevents them from rotating.

An advantage of this construction is that the needle drive collar can be mounted to the housing at a single point and no other mounting will be required for either the needle mount or the blade carriage and their associated mechanisms. Drive may be provided to both blade slide and needle drive collar by a system of eccentrics, cranks and connecting rods driven in different phases about the same rotating shaft.

In use the invention is able to achieve a doubling in productivity.

A further advantage of this compact tufting head is that the head can be fixed into a tufting machine in a pivotal manner. This allows the head to be pivoted away from its tufting position for replacement of the needle and blade without entirely removing the head from the tufting system. This overcomes the danger of introducing registration errors into the head during needle or blade replacement.

A cut-pile yarn brake may be incorporated into the head. The yarn brake may comprise an adjustable camming surface which rises and falls with the blade carriage, in order to drive a movable brake member into engagement with the yarn as the blade nears the bottom of its stroke. In one embodiment the body of the brake can serve to key the blade drive collar to the pulley.

When loop pile is being made it is necessary to cut the yarn when the head is to be moved from the end of one series of tufts to the beginning of another series at a different location. In order to achieve this a pin associated with the rotatable parts of the housing can be driven down by a piston associated with the stationary parts of the housing, in order to actuate the moveable brake member. Before this brake mechanism can be actuated it is necessary to rotate the head to align the pin and the piston. The head can then be driven through a complete cycle in order for the blade to cut the yarn before the head moves on to its new location.

When making cut-pile if the blade is too sharp the yarn may be cut prematurely as it is being driven into place by the blade. Conversely if the blade is not sharp enough then it may pull the preceding tuft before the yarn parts, giving rise to an uneven pile. In order to ensure the sharpness of the blade is not only adequate but is also constantly maintained, an insert of hard material such as diamond, or less preferably ceramic or tungsten carbide, may be inserted into the root of the fork in the blade. This has the further advantage of providing a hard cutting edge while at the same time allowing the use of a flexible non-brittle shaft on the blade. An additional, or alternative, technique is to apply ultrasonic vibration to the blade which causes it to be less affected by changes in sharpness at the cutting point. The ultrasonic vibrations may be introduced by applying the horn of an ultrasonic generator directly to the end of the blade, or the arrangement may be such that the horn only contacts the blade at the instant cutting is required.

The side-load on the blade needs to be high at the instant when the yarn is caught by the blade, to ensure the yarn is caught in the fork in the end of the blade. The side load must then be low or zero for the rest of the blade movement, so that the blade does not drag the tuft back out of the backing on the upstroke. In the known device the blade is bent to achieve a side load against the yarn. Advantageously it is proposed to mount a spring loaded blade on a pivoted block and to use an adjusting screw to control the angle of the blade and thereby the side load. A cam mechanism may be provided to raise the blade from the needle as the blade is retracted.

Another technique is to form a trench at the lower end of the needle so that the blade engages the yarn against the side of the needle and then, as it travels down, it enters the trench to release the load.

Whether or not a trench is formed in the needle, a groove may be formed along the needle, the arrangement being such that the blade captures the yarn in the groove. The use of a yarn groove has several benefits. First, it increases the volume of space available for containing the yarn as it is fed forward by the blade. When the yarn enters the needle it is grouped in the groove. As the blade feeds forward the 'V' of the blade tends to sweep any loose strands of yarn and funnel them towards the groove in the centre of the needle. As the yarn exits the needle, because it has been captured in a single group, all of its strands are presented for cutting by the blade. Also on the return stroke of the blade, with the bulk of the yarn sitting in the groove and the blade passing over the top of that groove, the tendency for the yarn to be dragged back out of the backing is reduced.

BRIEF DESCRIPTION OF THE DRAWINGS

The invention will now be described by way of example only, with reference to the accompanying drawings in which.

The same reference numerals have been used throughout the drawings to refer to corresponding elements.

BEST MODE FOR CARRYING OUT THE INVENTION

Figure 1:
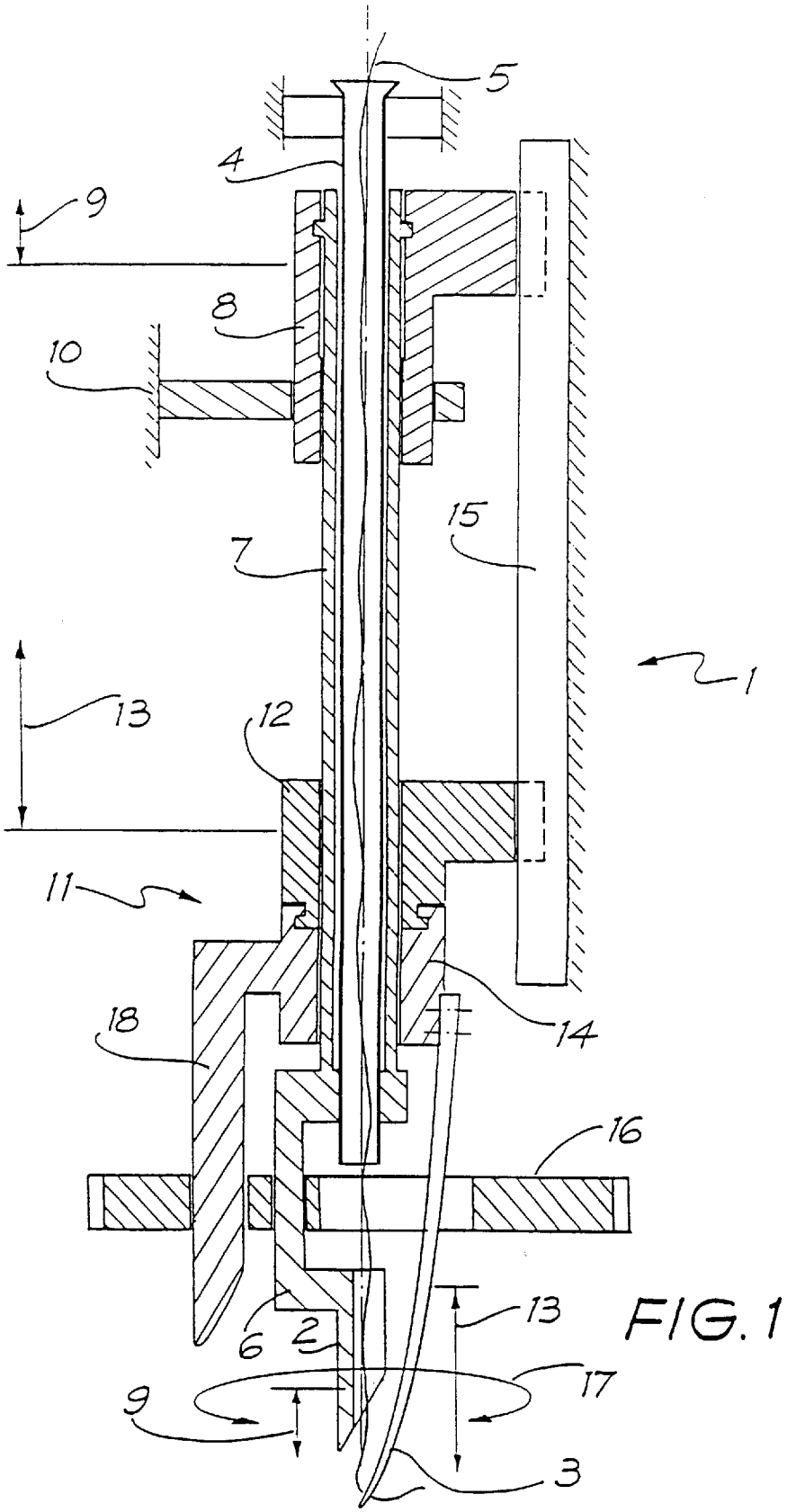
FIG. 1 is a schematic diagram illustrating the basic configuration of a tufting head embodying the invention.

Referring now to FIG. 1, tufting head 1 comprises a housing from the bottom end of which extends a needle 2 and a yarn driving blade 3. A stationary yarn tube 4 extends down through the housing to supply yarn 5 into the hollow interior of the needle 2.

The needle 2 is connected to a first reciprocating system which drives the needle up and down. The system comprises a needle mount 6 on which the needle is mounted, and extending upwardly from needle mount 6 is a hollow shaft 7. Shaft 7 extends up the outside of yarn tube 4 to a needle drive collar 8. Shaft 7 is able to rotate with respect to drive collar 8 about the axis of yarn tube 4. In use, drive collar 8, and therefore the needle 2, are driven up and down as shown by arrows 9. Needle drive collar 8 is also mounted to a bearing point 10 which supports the entire lower part of the mechanism.

The blade 3 is associated with a second reciprocating system. Blade 3 is mounted on a blade drive collar indicated generally at 11. The blade drive collar comprises a blade slider 12 which, in use, is driven up and down together with blade 3 as shown by arrows 13. Blade drive collar 11 also includes a blade carriage 14 which is rotatable with respect to blade slider 12 about the axis of yarn tube 4.

Blade slider 12 is keyed into a track 15 as is needle drive collar 8 in order to prevent them from rotating. The remaining parts of the mechanism, including needle 2 and blade 3 are able to be rotated together by means of a toothed pulley 16, as shown by arrow 17. Pulley 16 meshes with the needle mount 6 in order to turn needle 2 and hollow shaft 7 of the first reciprocating system. Pulley 16 is also keyed to the blade carriage 14 of blade drive collar 11 by means of a longitudinally extending member 18 in order to turn blade 3 and blade carriage 14 of the second reciprocating system, in unison with the rotation imparted to the needle 2.

A cycle of the operation of the tufting head to produce cut-pile will now be described with reference to FIG. 2.

Figures 2A, 2B, 2C, 2D, 2E:
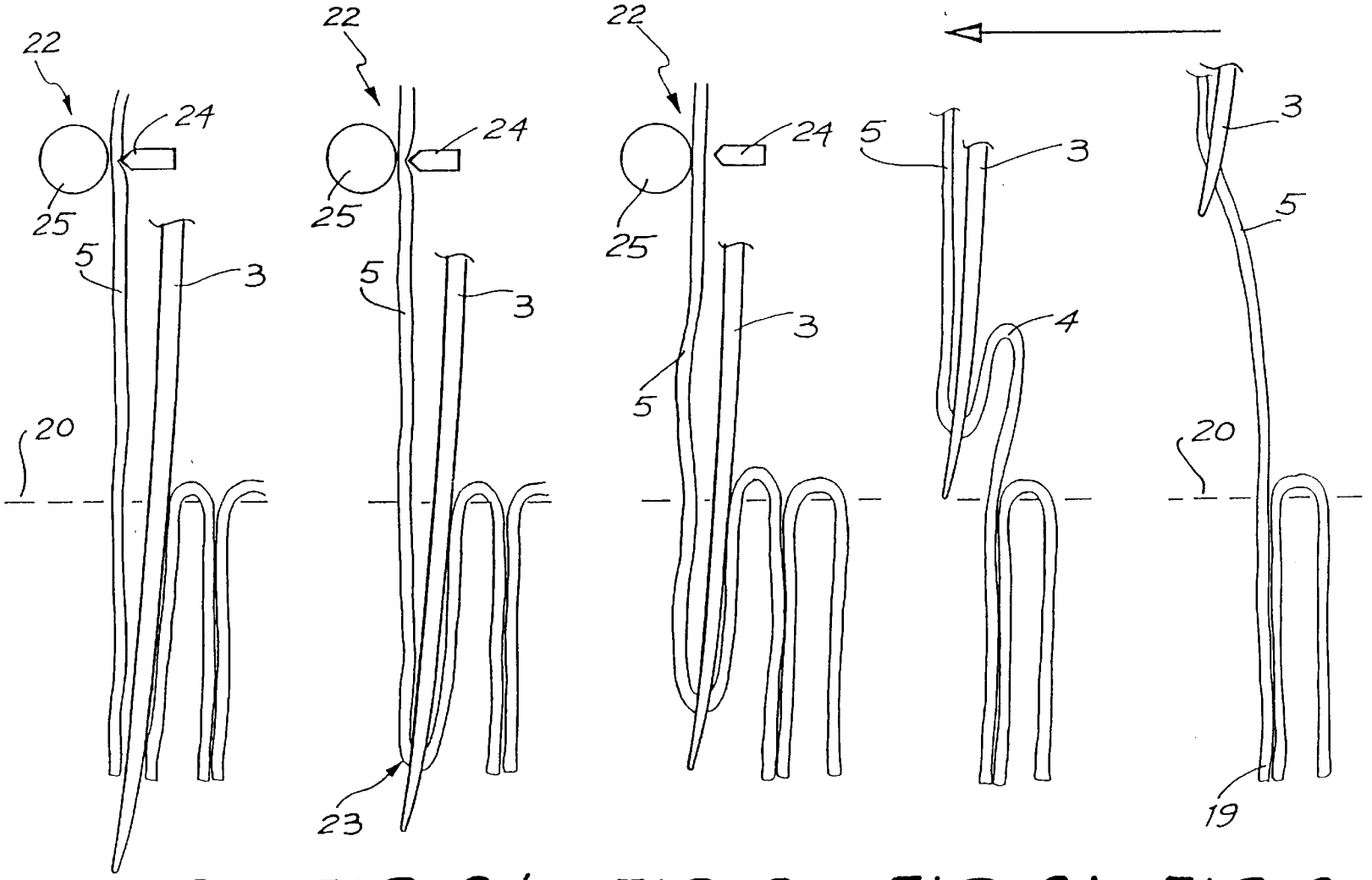
FIG. 2*a*–2*e* a schematic diagram showing the tufting cycle.

In FIG. 2*a*, blade 3 is at the top of its stroke and just about to grip yarn 5. The loose end 19 of the yarn is already inserted through the backing 20 to form a first tuft. The needle, not shown, has already opened a further hole in backing 20. As the blade 3 proceeds downward it engages yarn 5 driving the engaged portion downward and forming a loop 21 as shown in FIG. 2*b*.

In FIG. 2*c* the blade 3 has driven the yarn through the further hole in backing 20 almost to the full depth of the tuft and the cut pile yarn brake 22 is shown schematically to be off.

Blade 3 continues downward as shown in FIG. 2*d* until the tuft 23 fully located in place, at which point yarn brake 22 is driven on so that movable brake member 24 engages the fixed blade member 25. Further downward movement of blade 3 after this point in time severs the yarn, as shown in FIG. 2*e*, and the brake is then released. Blade 3 then begins its upward stroke, towards the position shown in FIG. 2*a*, as the needle travels down to open the next hole in backing 20.

Where loop pile is to be produced blade 3 is required only to push the yarn into place and not to cut it. As a result the downward stroke of blade 3 is determined by the height of the pile and the cut pile brake mechanism may be dispensed with or immobilised.

Figure 3B:
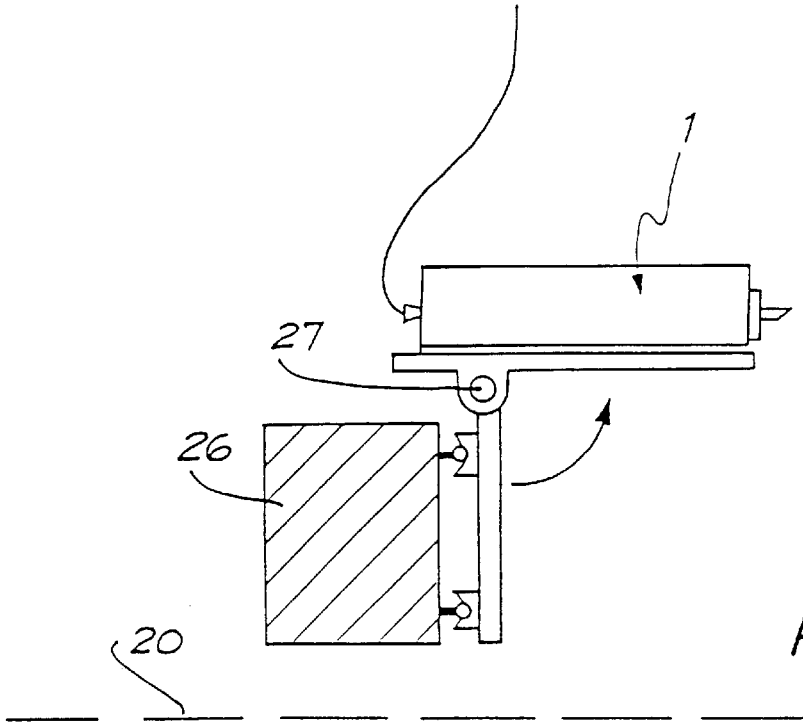
FIG. 3*b* shows a tufting head in its maintenance position.
Figure 3A:
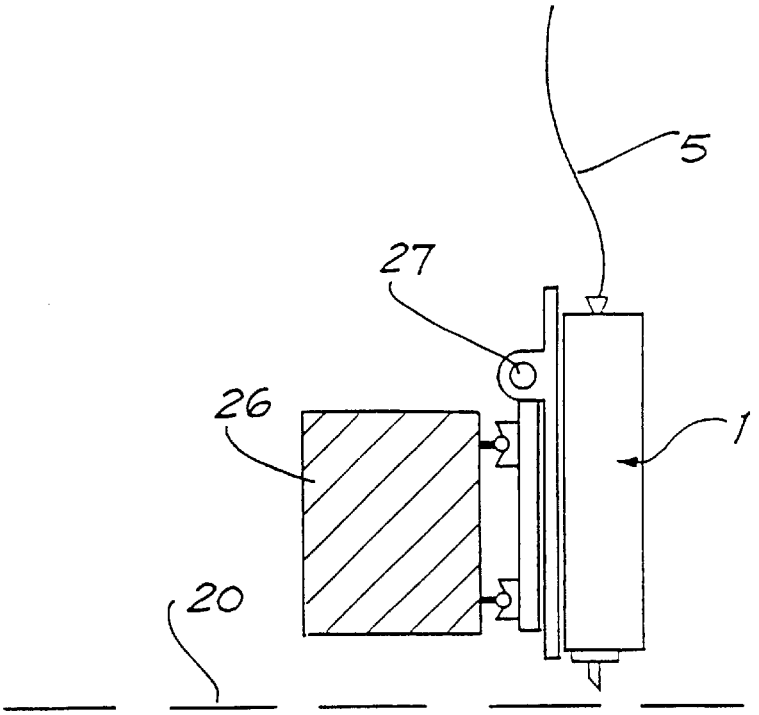
FIG. 3*a* shows a tufting head attached to an automatic tufting system in its operational position.

The tufting head is mounted to a movable carriage 26 in order to tuft backing 20 as shown in FIG. 3*a*. However, in order to replace the needle or the blade, tufting head 1 can be rotated about pivot point 27 to the position shown in FIG. 3*b* which allows easy access to the blade and needle. After maintenance tufting head 1 can be returned to its operational position and secured in place.

Figure 4:
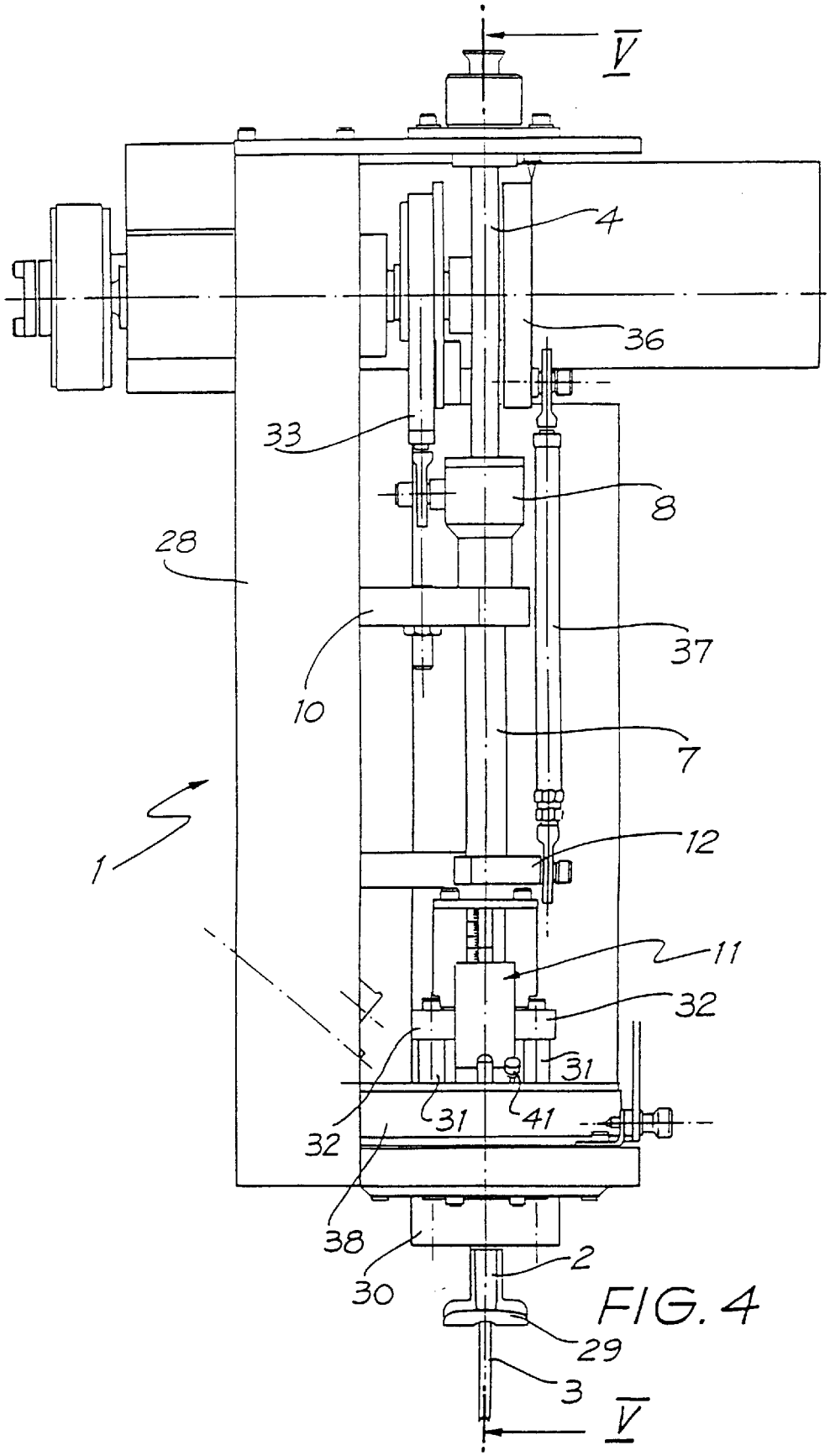
FIG. 4 is an elevation of another tufting head embodying the present invention, at a first position of its operational cycle.
Figure 5:
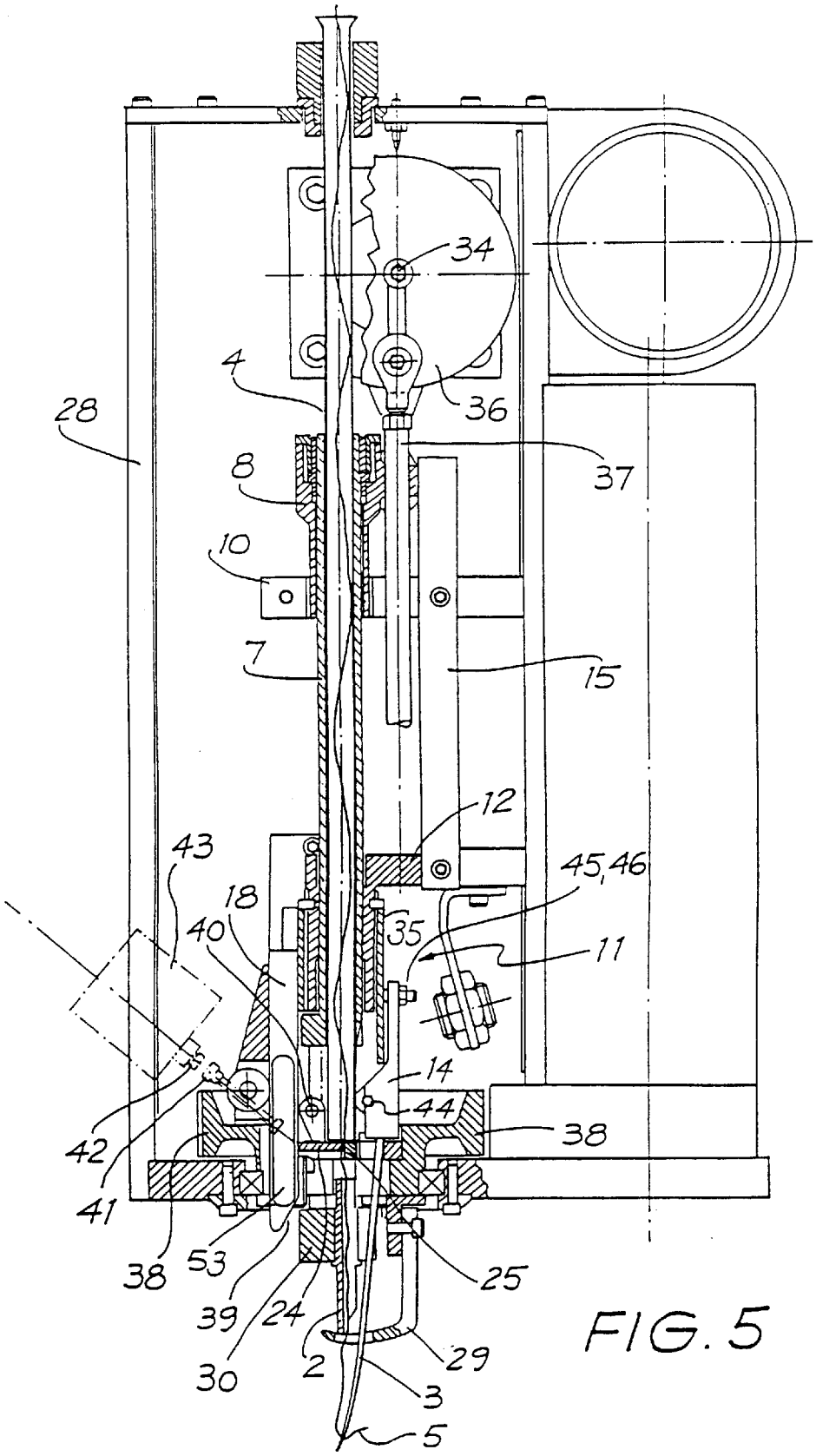
FIG. 5 is a partially cut-away cross-section of the tufting head of FIG. 4 at the first position.
Figure 6:
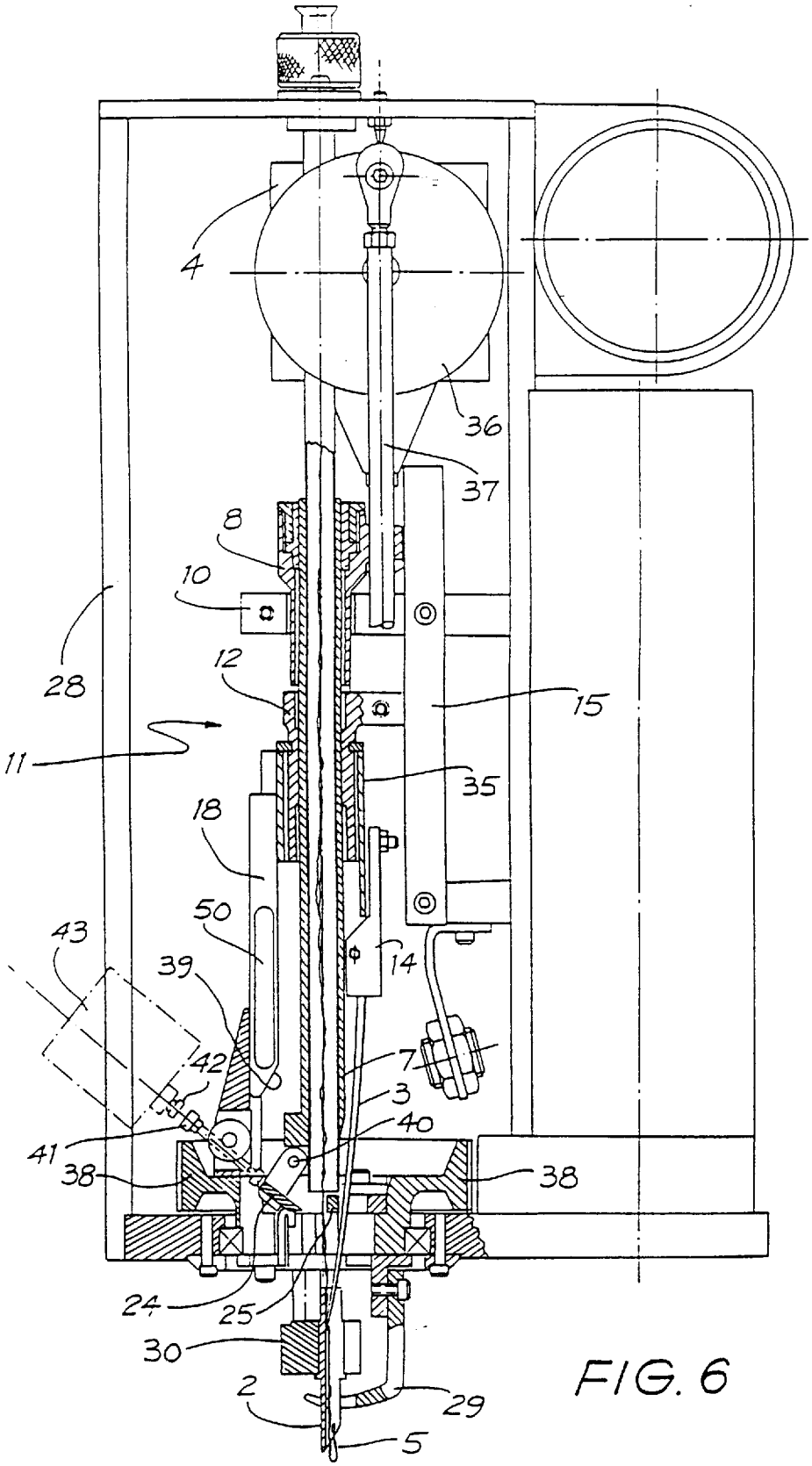
FIG. 6*a* is a partially cut-away cross-section of the tufting head of FIG. 4 at a second position in its operational cycle.

Referring now to FIGS. 4, 5 and 6, an alternative tufting head 1' comprises a housing 28 from the bottom end of which a needle 2, blade 3 and foot 29 protrude. A stationary yarn tube 4 extends down through the housing to supply yarn 5 into the hollow interior of the needle 2.

The needle 2 is connected to a first reciprocating system which drives the needle up and down. In detail the system comprises a cross piece 30 to which the needle is mounted. Extending upwardly upwards from cross piece 30 are two rods 31 interconnected by a yoke 32 which is integral with a hollow shaft 7 extending up the outside of yarn tube 4 to a needle drive collar 8. Shaft 7 is able to rotate with respect to drive collar 8 about the axis of yarn tube 4. Drive collar 8 is attached to a connecting-rod 33 which is in turn driven by an eccentric on electric motor drive shaft 34. Needle drive collar 8 is also mounted to a bearing point 10 which supports the entire lower part of the mechanism.

The blade 3 is associated with a second reciprocating system which is driven from the same motor drive shaft 34, but at a different phase. Blade 3 is connected to a pivoted block or blade carriage 14 which is connected to a blade drive collar indicated generally at 11. The blade drive collar comprises a blade slider 1 2 which is connected to a crank 36 by a second connecting- rod 37. Crank 36 rotates around electric motor drive shaft 34.

Blade drive collar 11 also includes a swivel housing 35 which is mounted about blade slider 12 and is rotatable with respect to blade slider 12 about the axis of yarn tube 4. Blade carriage 14 is directly connected to swivel housing 35 and blade 3 is therefore able to rotate.

Blade slider 12 is keyed into a track 15 as is needle drive collar 8 in order to prevent them from rotating. The remaining parts of the mechanism, including needle 2, blade 3 and foot 29 are able to be rotated together by means of a toothed pulley 38. Pulley 38 meshes with the bearings which support reciprocating rods 31 in order to turn everything in the first reciprocating system from needle 2 to hollow shaft 7. Pulley 38 is also keyed to the swivel housing 35 of blade drive collar 11 in order to turn everything in the second reciprocating system from blade 3 to swivel housing 35 in unison with the rotation imparted to the needle 2.

Pulley 38 is keyed to swivel housing 35 by means of a longitudinal extending brake cam 18. Brake cam 18 rises and falls with the second reciprocating system and the camming surface 39 cooperates with a movable brake member 24. Moveable brake member 24 is spring loaded to pivot, about pivot point 40, away from fixed brake member 25. When brake cam 18 is driven downwards camming surface 39 forces brake elements 24 and 25 against each other jamming the yarn between them to prevent it from being dragged further down the yarn tube.

A second, selective, brake mechanism uses a pin 41 to drive the movable brake element 24 against the fixed element 25. The pin is driven by a piston 42 driven from pneumatic cylinder 43 when the movable parts of the head are rotated to the correct orientation.

The angle of blade 3 can be seen to be controlled by blade carriage 14 pivoting about pivot point 44 using an adjustment screw 45 fixed by a lock nut 46, which acts against swivel housing 35. The blade pressure, the side load, is provided by a spring (not shown). The force exerted by the spring is regulated by adjustment screw 45. A cam (not shown) with a one way trip mechanism is attached to the pivoted block. During the forward motion of the blade the cam is tripped to make it inoperative, and the blade is acted on by the spring forcing it down against the needle. On retraction of the blade, the cam is activated by a cam track, overcoming the pressure from the spring, disengaging the blade from contact with the needle and lifting it; so eliminating or reducing the blade pressure. Electromechanical means may be employed whereby a solenoid is operated to lift the blade from contact with the needle, pivoting the blade about the pivot point in the pivoted block.

Figure 7A:
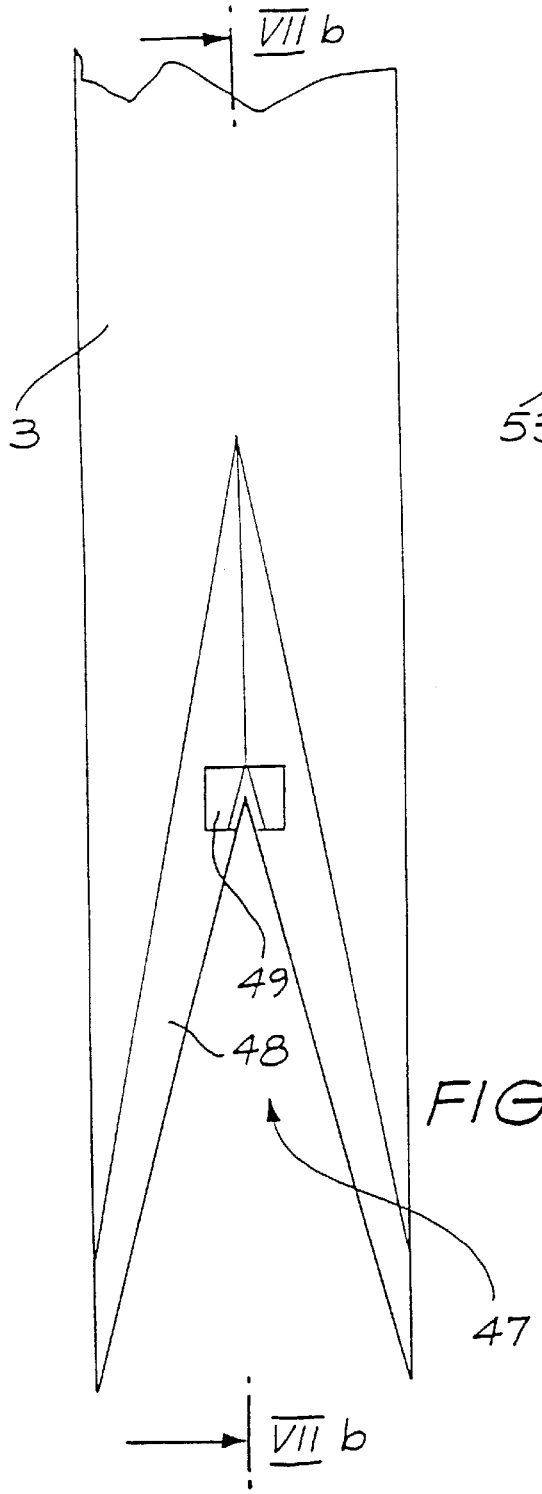
FIG. 7*a* is a detailed elevation of the blade.
Figure 7B:
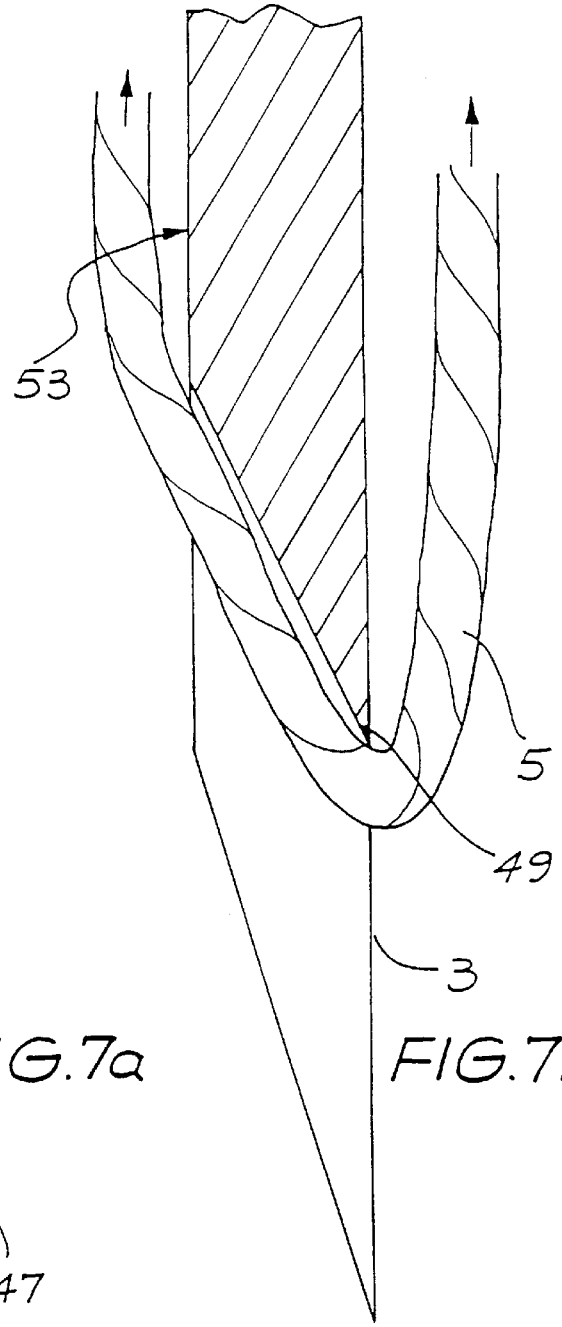
FIG. 7*b* is a cross-section of the blade of FIG. 7*a*.
Figure 8A:
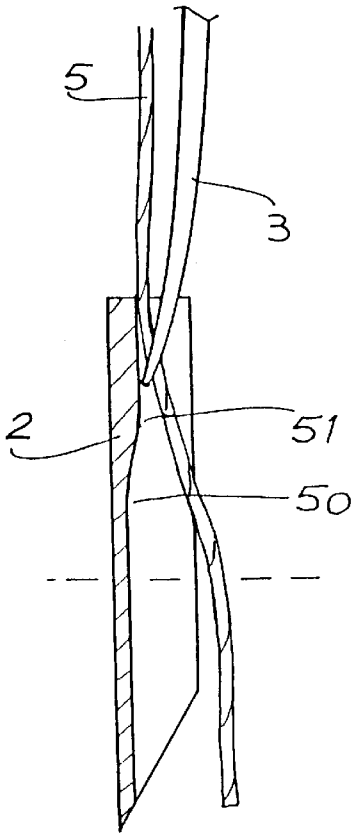
FIG. 8*a*–8*d* illustrate the use of a trench in the needle through the tufting cycle.
Figure 8B:
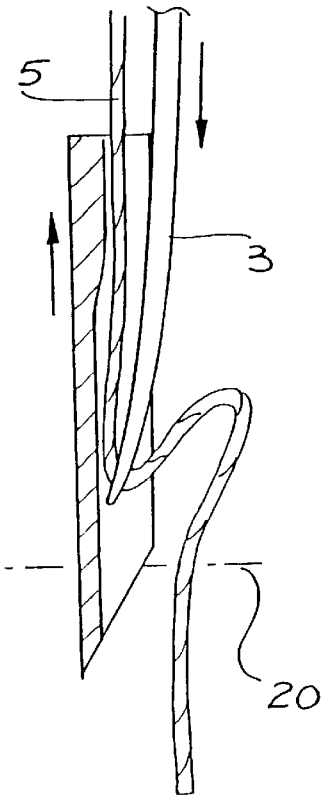
Figure 8C:
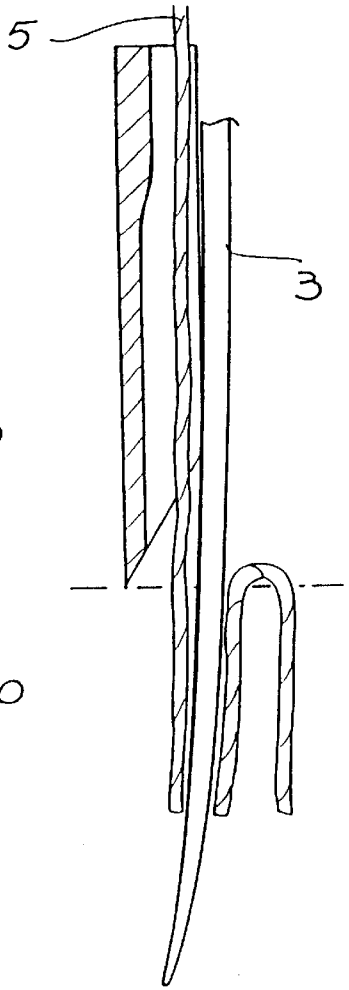
Figure 8D:
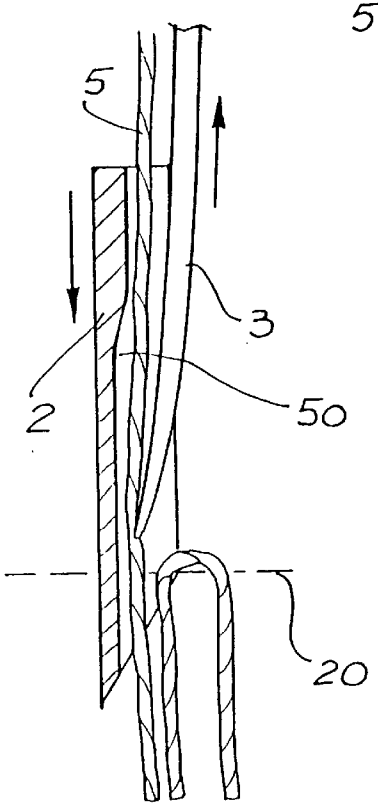

FIG. 7*a* and 7*b* show blade 3 in greater detail, and in particular show the V-shaped fork 47 in the end of the blade. The fork has sharpened surface 48 which engages yarn 5 on its down stroke and pulls it through yarn tube 4. At the point of the V an insert of hard material such as diamond 49 is able to cut the yarn when it is forced against the insert. This happens when one or other of the yarn brakes is on, and the blade is driven downwardly. Ultrasonic vibration may also be introduced onto the blade to assist in cutting.

Referring now to FIG. 8 the effect of a trench 50 in the back of needle 2 will be illustrated. As blade 4 begins its down stroke, FIG. 8*a*, its tip is engaged against the inner wall 51 of needle 2 and the yarn 5 is gripped in the V-shaped fork 47. Once the yarn has been gripped and the blade continues its downstroke, further side loading is not required and indeed may cause damage to the yarn. The tip of the blade enters trench 50, FIG. 8*b*, in order to release the side loading. The yarn is looped over and pushed through the backing in order to create the next tuft. In FIG. 8*c* the blade 3 has driven the yarn through backing 20 and cut the pile. In FIG. 8*d* as the blade is withdrawn on its upstroke no side loading is applied until the blade has risen and the needle 2 has fallen to the point in time when the blade has next gripped the yarn 5.

Figure 9B:
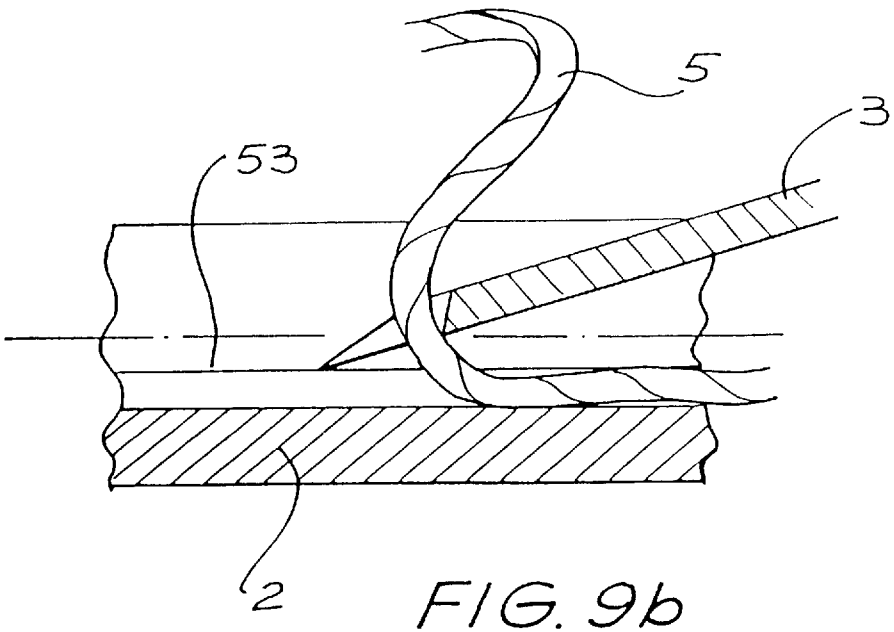
FIG. 9*b* is a longitudinal section.
Figure 9A:
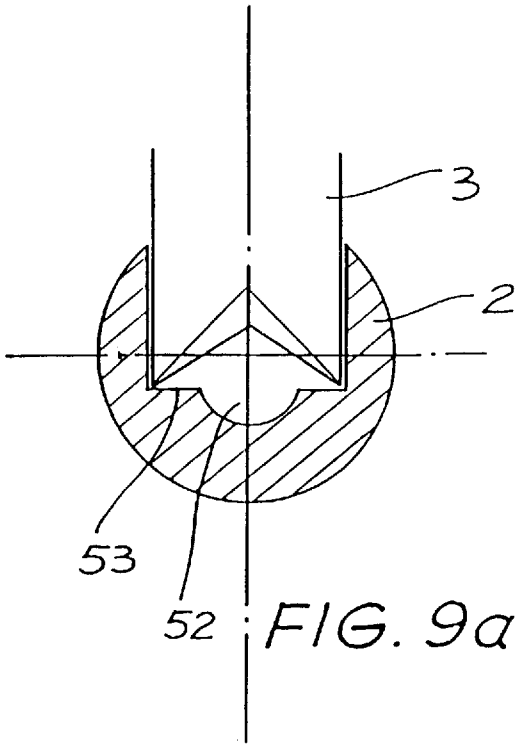
FIG. 9*a* is a cross-section through a needle illustrating the use of a yarn capture groove.

Whether or not a trench is employed a yarn capture groove 52 may be provided in the needle 2, below the blade track 53, along which the blade normally catches and feeds the yarn. This groove 52 is shown together with the blade 3 in FIGS. 9*a* and 9*b*. In use, yarn travels through the needle in this groove.

When loop pile is to be produced the cut-pile brake can conveniently be immobilised by raising cut-pile brake cam 18 up the slotted link 53 indicated on FIGS. 5 and 6. At the end of a length of loop pile, if it is not intended to continue but to stop tufting and move the head to another location before beginning tufting again, then the loop pile yarn brake is brought into operation by aligning pin 41 with piston 42. Then driving piston 42 out of cylinder 43 engaging the brake, and driving the blade through one revolution of its cycle in order to part the yarn.

Although the invention has been described with reference to a particular embodiment it should be appreciated that it may be embodied in many other forms. For instance, instead of using a simple passive forked blade, it is possible to incorporate a scissor mechanism into the end of the blade in order to actively cut the yarn at the desired point in the cycle.

We claim:

1. A mechanical tufting head, comprising:

a first reciprocating system comprising a hollow shaft having lower and upper ends and a tufting needle mount connected to the lower end of the hollow shaft;

a stationary yarn tube extending through the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft.

2. A mechanical tufting head according to claim 1, wherein the needle mount and blade carriage are turned by the use of a gear means situated in the lower part of the head.

3. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft;

a needle drive collar rotatably connected to the upper end of the hollow shaft; and a blade slide rotatably connected to the blade carriage, wherein the blade slide and the needle drive collar are both keyed into a track which allows them to reciprocate but prevents them from rotating.

4. A mechanical tufting head according to claim 3, further comprising means for driving both the blade slide and the needle drive collar by a system of eccentrics, cranks and connecting rods driven in different phases about a common rotating shaft.

5. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft; and a cut pile-yarn brake incorporated into the blade carriage, comprising an adjustable camming surface which rises and falls in synchronism with the blade carriage in order to drive brake members into engagement with the yarn at a predetermined point in each cycle.

6. A mechanical tufting head according to claim 5 wherein:

the needle mount and blade carriage are turned by the use of a gear means situated in the lower part of the head; and the body of the brake serves to key the blade carriage to the gear means.

7. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft; and a selective yarn brake comprising a yarn brake member, a piston and a pin, the pin being selectively driven down by the piston to actuate the yarn brake member.

8. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft;

wherein the blade carriage comprises a blade mounted thereto; and means for adjustably and pivotally mounting the blade carriage relative to the hollow shaft to control the angle of the blade and thereby a side load on the yarn.

9. A mechanical tufting head according to claim 8, wherein a cam mechanism is provided to raise the blade from the needle as the blade is retracted.

10. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft;

a needle mounted in the needle mount and a blade mounted to the blade carriage to engage yarn extending along the yarn path, wherein a trench is formed at the lower end of the needle, and further comprising means for loading the blade to engage the yarn against the side of the needle, so that the blade will, as it travels down, enter the trench to release a load.

11. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft;

a needle mounted in the needle mount and a blade mounted in the blade carriage, wherein a groove is formed along the needle, and further comprising means for loading the blade to engage yarn against a side of the needle and capture the yarn in the groove.

12. A mechanical tufting head comprising:

a first reciprocating system comprising a hollow shaft having lower and upper ends and a tufting needle mount connected to the lower end of the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft;

a forked blade connected to said blade carriage, wherein said forked blade has a root, and an insert of hard material positioned in the root of the fork in the blade.

13. A mechanical tufting head comprising:

a first reciprocating system comprising a hollow shaft having lower and upper ends and a tufting needle mount connected to the lower end of the hollow shaft;

a stationary yarn tube extending through the hollow shaft;

means for mounting the first reciprocating system for rotation about and reciprocation along a yarn path axis; and a blade carriage mounted about the hollow shaft, such that the blade carriage is able to rotate with respect to the axis of the yarn path and reciprocate along the hollow shaft;

a needle mounted in the needle mount;

a blade mounted in the blade carriage; and means for loading the blade to engage yarn against a side of the needle.

* * * * *